US007652592B2

(12) United States Patent
Le Briere et al.

(10) Patent No.: US 7,652,592 B2
(45) Date of Patent: Jan. 26, 2010

(54) DATA TRANSMISSION DEVICE

(75) Inventors: Bruno Le Briere, Paris (FR); Vincent Chatelet, Le Blanc-Mesnil (FR); François Millet, Antony (FR)

(73) Assignee: Geoservices, Le Blanc-Mesnil (FR)

( * ) Notice: Subject to any disclaimer, the term of this patent is extended or adjusted under 35 U.S.C. 154(b) by 597 days.

(21) Appl. No.: 10/538,503

(22) PCT Filed: Nov. 28, 2003

(86) PCT No.: PCT/FR03/03526

§ 371 (c)(1),
(2), (4) Date: Jun. 9, 2005

(87) PCT Pub. No.: WO2004/063528

PCT Pub. Date: Jul. 29, 2004

(65) Prior Publication Data

US 2006/0044155 A1 Mar. 2, 2006

(30) Foreign Application Priority Data

Dec. 10, 2002 (FR) ..... 02 15608

(51) Int. Cl.
*G01V 3/00* (2006.01)

(52) U.S. Cl. ..... 340/854.6; 340/854.5; 340/854.9; 340/855.2

(58) Field of Classification Search ..... 340/854.5, 340/854.6, 854.9, 855.2
See application file for complete search history.

(56) References Cited

U.S. PATENT DOCUMENTS 5,394,141 A * 2/1995 Soulier ..... 340/854.4

FOREIGN PATENT DOCUMENTS

WO 01/20129 3/2001

* cited by examiner

*Primary Examiner*—Brian A Zimmerman
*Assistant Examiner*—Hung Q Dang
(74) *Attorney, Agent, or Firm*—Wenderoth, Lind & Ponack, L.L.P.

(57) ABSTRACT

The device relates to an installation comprising a cavity extending from the surface of the ground and provided with at least one electrically conductive tubular element. The device comprises a single-strand smooth cable for supporting an action and/or measurement assembly, which cable is electrically conductive and has a breaking strength greater than 300 daN, and is disposed in the tubular element. The surface of the cable is electrically insulated at least in part from said tubular element. The device includes transmitter means and receiver means for transmitting and receiving an electrical and/or electromagnetic signal, said means being situated in the vicinity of the surface and in the cavity, and being electrically connected to the cable and to the tubular element and/or an underground formation. The invention is applicable to transmitting information and to controlling tools in an oil well.

20 Claims, 4 Drawing Sheets

DATA TRANSMISSION DEVICE

BACKGROUND OF THE INVENTION

1. Field of the Invention

The present invention relates to a device for transmitting data in an installation for working fluids contained underground, the installation comprising a cavity defined in an underground formation and extending from the surface of the ground. The cavity is provided with at least one electrically conductive tubular element, and the device is of a type comprising a single-strand smooth cable for supporting an action and/or measurement assembly. The cable has a breaking strength greater than 300 decanewtons (daN), and is made of an electrically conductive material and disposed in the tubular element between a first point at the surface of the ground and a second point within the cavity. The invention also relates to an associated installation for working fluids contained underground.

The term "tubular element" is used to designate an element that is hollow and elongated, for example an element that is substantially cylindrical.

2. Description of Related Art

It is known to use single-strand smooth cables of the "piano wire" or "slickline" type to perform various mechanical operations (commonly referred to as "cable operations" or "slickline operations") down an oil well or a well for some other effluent (in particular gas, steam, water). By way of example, such operations may be opening and closing valves, putting elements into place, or perforating a wall.

These cables which are referred to as "smooth cables" or "piano wire" in the present application, present the advantage of being simple to use. By their very nature they possess good mechanical properties, unlike twisted electrical cables. Providing sealing at the wellhead is significantly easier with "piano wire" type cables than it is with twisted electrical cables.

Nevertheless, use of such cables is limited to a mechanical function, and that can present drawbacks. For example, with perforation operations, when an explosive charge is lowered down a well at the end of a piano wire type cable, a timer is provided to trigger the explosive at the end of a predetermined length of time. Under such circumstances, an operator at the surface has no way of being sure that the explosion has indeed taken place, and when the cable is raised back to the surface, the tool may contain undetonated residual explosive, which can be dangerous.

Twisted electrical cables are also known that enable transmission of electrical signals. Nevertheless, such cables are more expensive, and handling them at a wellhead is more complicated than handling a smooth cable.

BRIEF SUMMARY OF THE INVENTION

A main object of the present invention is to provide means that are particularly simple and inexpensive for transmitting data between a control device on the surface and a tool located at the end of a piano wire type cable, or between measurement means situated in the well and the surface.

To this end, the invention provides a device of the above-specified type, characterized in that the surface of the cable is electrically insulated, at least in part, from said tubular element, and in that the device further comprises transmitter means for transmitting an electrical and/or electromagnetic signal, situated in the vicinity of one or both of the first and second points, and receiver means for receiving an electrical and/or electromagnetic signal situated in the vicinity of the other one or both of the first and second points; each of said transmitter means and said receiver means being electrically connected firstly to the cable and secondly to the tubular element and/or to the underground formation; the cable constituting a portion of a loop for conveying the electrical and/or electromagnetic signal between the transmitter means and the receiver means.

The device of the invention may include one or more of the following characteristics taken alone or in any technically feasible combination:

- the surface of the cable carries a continuous coating of insulating material and is electrically insulated from said tubular element;
- the thickness of the continuous coating of insulating material is equal to half the difference in diameter between two standard and non-coated cables;
- the surface of the cable is provided at regular intervals with centralizers of insulating material for electrically insulating said tubular element;
- the transmitter and receiver means in the vicinity of the first and second points are electrically connected to said tubular element and the signal transmitted by the transmitter means and received by the receiver means is an electrical signal;
- the cavity is provided with at least a first tubular element and a second tubular element disposed inside the first element, and the cable is disposed in the annular space between the first and second elements;
- the surface of the cable has at least one electrical contact point with said tubular element, and the transmitter means and/or receiver means in the vicinity of the first and second points and said tubular element are electrically connected to the underground formation;
- the electrical signal transmitted by the transmitter means in the vicinity of the first point is injected to a first dipole comprising firstly an electrical contact point between the cable and the transmitter means in the vicinity of the first point, and secondly an electrical contact point between the formation and the transmitter means in the vicinity of the first point; the first dipole generating an electromagnetic signal that is received by a second dipole comprising firstly one of said electrical contact points between the cable and the tubular element, and secondly an electrical contact point between the tubular element and the receiver means in the vicinity of the second point, with the electromagnetic signal received by the second dipole generating an electrical signal which is conveyed to the receiver means in the vicinity of the second point;
- the electrical signal transmitted by the transmitter means in the vicinity of the second point is injected into a second dipole comprising firstly one of said electrical contact points between the cable and the tubular element, and secondly an electrical contact point between the tubular element and the transmitter means in the vicinity of the second point, said second dipole generating an electromagnetic signal received by a first dipole comprising, firstly an electrical contact point between the cable and the receiver means in the vicinity of the first point, and secondly an electrical contact point between the formation and the receiver means in the vicinity of the first point; the electromagnetic signal received by the first dipole generating an electrical signal that is conveyed to the receiver means in the vicinity of the first point;
- the electrical contact between the underground formation and the transmitter and/or receiver means in the vicinity of the first point takes place via a conductor member anchored in the ground;

the transmitter means and the receiver means for transmitting and receiving an electrical and/or an electromagnetic signal are situated in the vicinity of respective ones of the first and second points; and the transmitter means for transmitting an electrical and/or an electromagnetic signal are situated solely in the vicinity of one of the first and second points, and the receiver means for receiving an electrical and/or an electromagnetic signal are situated solely in the vicinity of the other one of the first and second points.

The invention also provides an installation for working fluids contained underground, the installation comprising a cavity defined in an underground formation extending from the surface of the ground and closed on the surface by a wellhead, said cavity being provided with at least one electrically conductive tubular element, characterized in that it includes a transmission device as defined above.

The installation of the invention may include one or more of the following characteristics taken alone or in any technically feasible combination:

it includes an applicator device for applying an insulating coating on the cable;

the wellhead is preceded by an airlock provided with a sealing device for the cable, and the applicator device for applying the insulating coating on the cable is disposed inside the airlock downstream from the sealing device; and it includes deployment means and an alignment device for putting the cable into alignment in the wellhead, the alignment device comprising at least one sheath, the installation being characterized in that the applicator device for applying the insulating coating on the cable is disposed between the deployment means and the alignment device, and the or each sheath is electrically insulated from the wellhead and/or the underground formation.

BRIEF DESCRIPTION OF THE DRAWINGS

Embodiments of the invention are described below with reference to the accompanying drawings, in which.

DETAILED DESCRIPTION OF THE INVENTION

Figure 1:
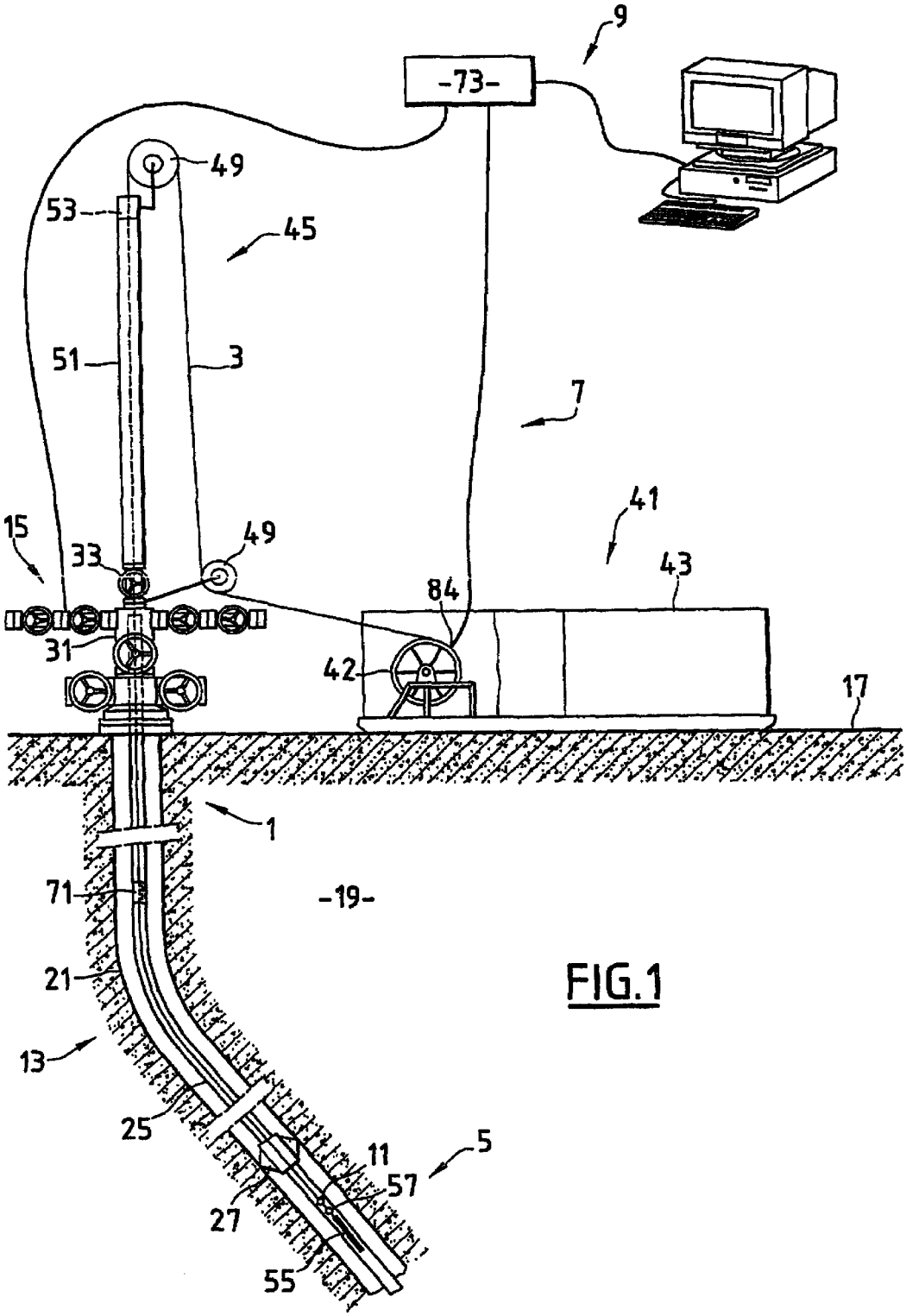
FIG. 1 is a diagram of a first configuration of a transmission device of the invention.

A device of the invention is used, for example, when taking action in an oil production well installation 1, such as taking measurements down the borehole or a perforation operation implemented by means of a tool mounted at the end of a cable of the piano wire type.

The device comprises a smooth cable 3 supporting an assembly 5 for taking action and/or measurements, and associated with deployment means 7. The device further comprises first means 9 and second means 11 for transmitting/receiving an electrical and/or electromagnetic signal.

The oil production well installation 1 has a cavity 13 or "well" closed by a wellhead 15 on the surface of the ground 17.

This cavity 13 is generally tubular in shape. It extends from the surface of the ground 17 to the layer of fluid to be worked (not shown) situated at depth in a subsurface formation 19. It is defined by an outer first tubular duct 21 referred to as "casing", made up of an assembly of tubes made of electrically conductive material (metal).

A second tubular duct 25 (referred to as "production tubing") of smaller diameter is mounted inside the first duct 21 and is likewise constituted by an assembly of metal tubes. The second duct 25 is held substantially in the center of the first duct 21 by means of bladed centralizers 27 made of electrically conductive material (metal).

The wellhead 15 comprises a body 31 of electrically conductive material and is provided with a servicing valve 33.

The body 31 of the wellhead 15 is mounted at the end of the first duct 21 at the surface of the ground 17. The end of the second duct 25 is mounted inside the body 31. The second duct 25 is closed by the servicing valve 33 which is situated in line with the second duct 25.

The smooth cable 3 is a single-strand cable of the piano wire type or of the slickline type. It is made of a metal, such as galvanized steel or stainless steel (e.g. of the 316 type). The smooth cable possesses good traction strength and adequate flexibility. Typically, this type of cable has a breaking load in the range 300 daN to 1500 daN, and preferably in the range 600 daN to 1000 daN, and relatively high electrical resistivity, typically lying in the range 30 milliohms per meter (mΩ/m) to 500 mΩ/m, and preferably lying in the range 35 mΩ/m to 300 mΩ/m.

The diameter of the smooth cable 3 is adapted for insertion into the wellhead 15. Typically the diameter of cables of this type lies in the range 1 millimeter (mm) to 5 mm, and preferably in the range 1.5 mm to 4 mm.

The smooth cable 3 is inserted into the second duct 25 by the deployment means 7. These means 7 comprise a winch 41 provided with a drum 42 associated with a hydraulic or electrical unit 43 and an alignment and sealing device 45.

The deployment means 7 for deploying the smooth cable 3 may be placed on the ground 17 or possibly they may be on board a vehicle (not shown).

The first end of the smooth cable 3 is secured to the drum 42. The alignment and sealing device 45 comprises two deflector pulleys 49, an airlock 51, and a packer 53.

Since the outside surface of the cable 3 is smooth, sealing through the airlock 51 can be achieved using a simple packer 53.

The smooth cable 3 carries an action and/or measurement assembly 5 at its free end, comprising, under such circumstances, an active portion 55, in particular a tool, together with a control portion 57.

The tool 55 enables one or more operations to be performed in the well. These operations are controlled from the surface of the ground 17 using the data transmission device of the invention.

In the first embodiment (FIG. 1), the outside surface of the smooth cable 3 is completely insulated electrically from the second duct 25. To do this, an electrically insulating material is applied to the outside surface of the smooth cable 3.

This continuous insulating material may be selected from a thermoplastic material, a paint, or a resin, and it may be applied in a permanent manner on the cable. It may also be applied in a temporary manner, in which case it is selected from amongst greases, lubricants, tars, and analogous substances.

Figure 2:
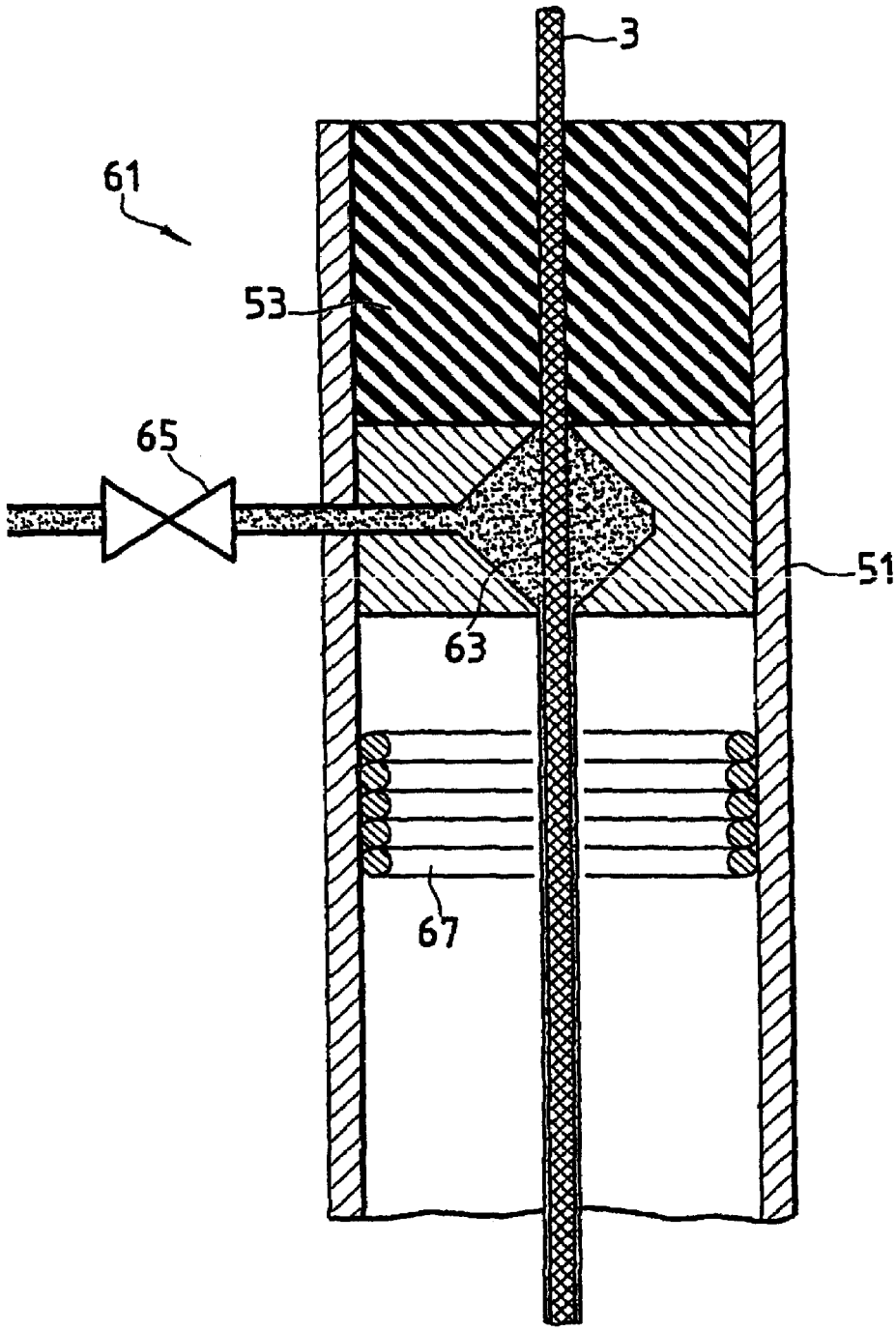
FIG. 2 is a diagram of a device for in situ application of an insulating coating on the surface of the cable of the piano wire type.

The insulating material may be applied onto the smooth cable 3 while the cable 3 is being drawn or conditioned. This application may also be performed off-site, in the vicinity of the cavity 13, by means of an applicator device 61 described with reference to FIG. 2.

The applicator device may be interposed in the airlock 51 between its end 53 and the servicing valve 33 of the wellhead. It comprises a chamber 63 for applying an insulating substance injected through a valve 65, and means 67 for heating, melting, or curing the substance, for example induction heater turns.

If the applicator device 61 is placed in the airlock 51, the deflector pulley 49 and the drum 42 need to be electrically insulated from the wellhead and/or the formation 19 so as to ensure that the transmission device of the invention operates properly.

In a variant, the applicator device 61 may alternatively be placed between the winch 41 and the bottom deflector pulley 49.

Advantageously, it is possible to use a standard smooth cable 3 that is not coated (e.g. having a diameter of 2.34 mm or of 2.74 mm) and to apply on the smooth cable 3 a coating of thickness equal to half the difference in diameter between said cable 3 and a standard smooth cable of larger diameter. Thus, the smooth cable 3 once coated is of a standard size for existing "slickline" equipment (2.74 mm or 3.17 mm in the above example). The coated smooth cable 3 then adapts easily to existing slickline equipment.

In a variant of the invention that is not shown, the smooth cable 3 may be electrically insulated from the second duct by means of centralizers 71 of insulating material disposed at regular intervals along the second duct 25, without using an insulating coating.

First transceiver means 9 for transmitting and receiving an electrical signal is disposed in the vicinity of the wellhead 15. It comprises a control unit 73 that is electrically connected both to the smooth cable 3 and to the wellhead 15.

Second transceiver means 11 for transmitting and receiving an electrical signal are mounted at the second end of the smooth cable 3 in the vicinity of the tool 55. The second transceiver means 11 is connected to the control portion 57. In this first transmission device of the invention, this means 11 is also electrically connected firstly to the smooth cable 3 and secondly to the second duct 25.

Each of the first and second transceiver means comprises an electronic circuit and a power supply, e.g. a battery. These means are capable of transmitting and receiving a modulated alternating electrical signal at low or medium frequency. Such means are known in themselves and are not described in detail. An example of a transceiver suitable for use in the device is made available by the supplier Geoservices under the name WTD (wireless transmitted data).

The term low or medium frequency covers frequencies in the range 1 hertz (Hz) to 50,000 Hz, and preferably in the range 5 Hz to 5000 Hz. Data transmission between the transmitter means and the receiver means takes place over distances lying in the range 0 to 10,000 meters (m), and preferably over the range 500 m to 6000 m.

The electrical signal transmitted from the surface downhole is, under such circumstances, a control signal generated by the operator, while the electrical signal transmitted from down the hole to the surface is a confirmation signal generated by the control portion 57.

The current injected by the transmitter means 9, 11 lies in the range 0 to 10 amps (A), preferably in the range 0 to 2 A, at a voltage lying in the range 0 to 50 volts (V), and preferably in the range 5 V to 25 V. These means are identical to those commonly used in the context of transmitting data by means of an electromagnetic signal.

In a variant, a current source of the kind used for transmitting signals over a twisted electrical cable could be used in this first embodiment. An example of a current source suitable for this use is made available by the supplier Geoservices under the name Emrod® shuttle.

Furthermore, when it is necessary only to transmit from the surface down the well, e.g. merely to issue a command, the operator on the surface actuates a simple transmitter means 9 and the action and/or measurement assembly 5 need be provided solely with receiver means 11.

In another variant, the action and/or measurement assembly 5 may also include means (not shown) for detecting physical quantities, such as temperature, pressure, flow rate, depth, status of a downhole valve, natural radiation from the terrain (gamma radiation), location of casing seals "Casing Collar Locator", etc.

When merely performing measurements downhole, the action and/or measurement assembly 5 may comprise solely detector means and a transmitter means 11, in which case the surface is fitted solely with receiver means 9.

The operation of the first device of the invention during a perforation operation is described below by way of example.

When the action and/or measurement assembly 5 has reached the desired depth, the first transceiver means 9 at the surface of the ground 17 sends an electrical control signal in the form of a modulated electrical current. Since the smooth cable 3 is electrically insulated from the second duct 25, a current loop is established between the first transceiver means 9, the smooth cable 3, the second transceiver means 11, the second duct 25, and the wellhead 15. In spite of the poor electrical conductivity properties of the cable 3, the electrical control signal is conveyed to the control member 57 of the action and/or measurement assembly 5 via the cable 3. The active portion 55 of the action and/or measurement assembly 5 then performs the command, for example it triggers an explosive charge.

When the active portion 55 of the action and/or measurement assembly 5 has finished executing a command, the second transceiver means 11 sends an electrical confirmation signal in the form of an electrical current that flows around the above-described current loop. This confirmation signal is received by the first transceiver means 9. An operator on the surface can thus receive confirmation that the commanded operation has been performed properly and can move on to the following operation (e.g. raising the cable together with the action and/or measurement assembly).

Figure 3:
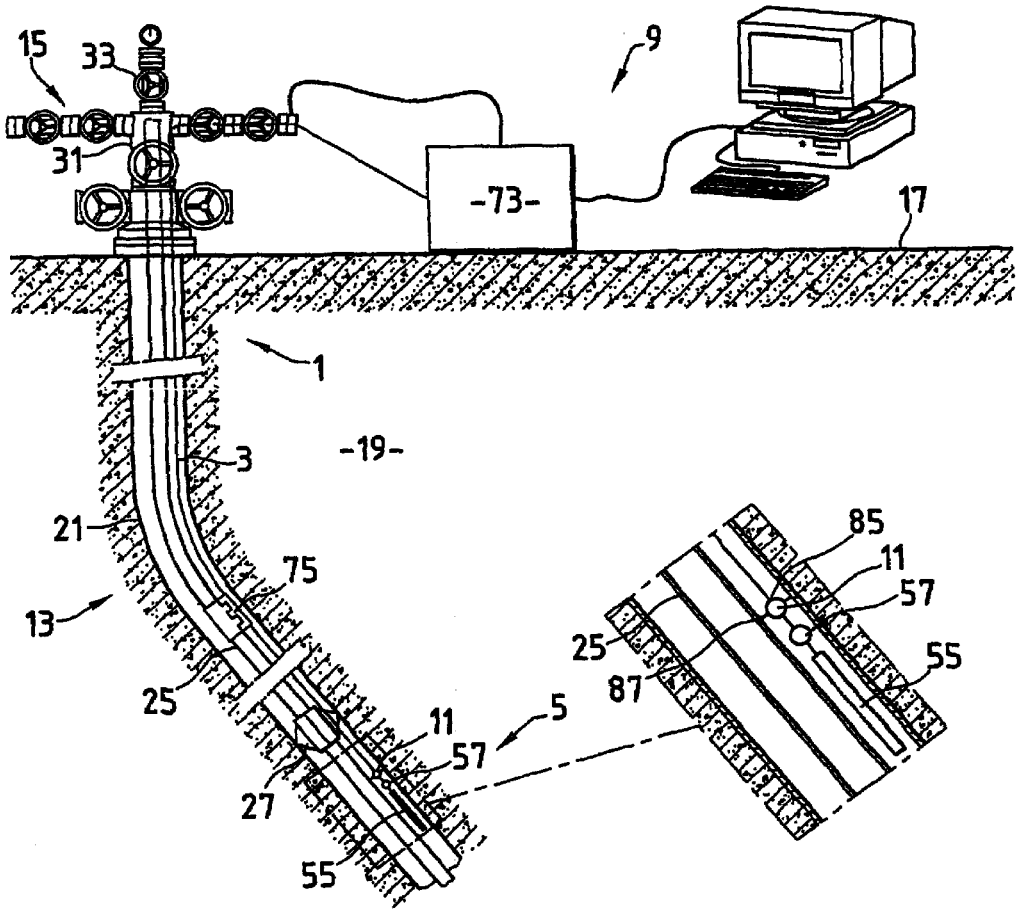
FIG. 3 is a diagram of a second configuration of a transmission device of the invention.

A second data transmission device of the invention is shown in FIG. 3.

Unlike the first device of the invention, the smooth cable 3 is placed in the annular space between the first duct 21 and the second duct 25.

This smooth cable 3 is installed permanently in the oil production well installation shown in FIG. 3. For this purpose, the smooth cable 3 may be secured to the outside surface of the second duct 25 by fasteners 75 that are put into position while the second duct 25 is itself being put into place inside the first duct 21.

In this second device of the invention, the outside surface of the smooth cable 3 is coated in an insulating material that is applied on a permanent basis.

Unlike the installation shown in FIG. 1, the deployment means 7 are no longer necessary. The smooth cable is thus connected directly to the control unit 73.

The operation of the second device of the invention is otherwise identical to that of the first device of the invention.

Figure 4:
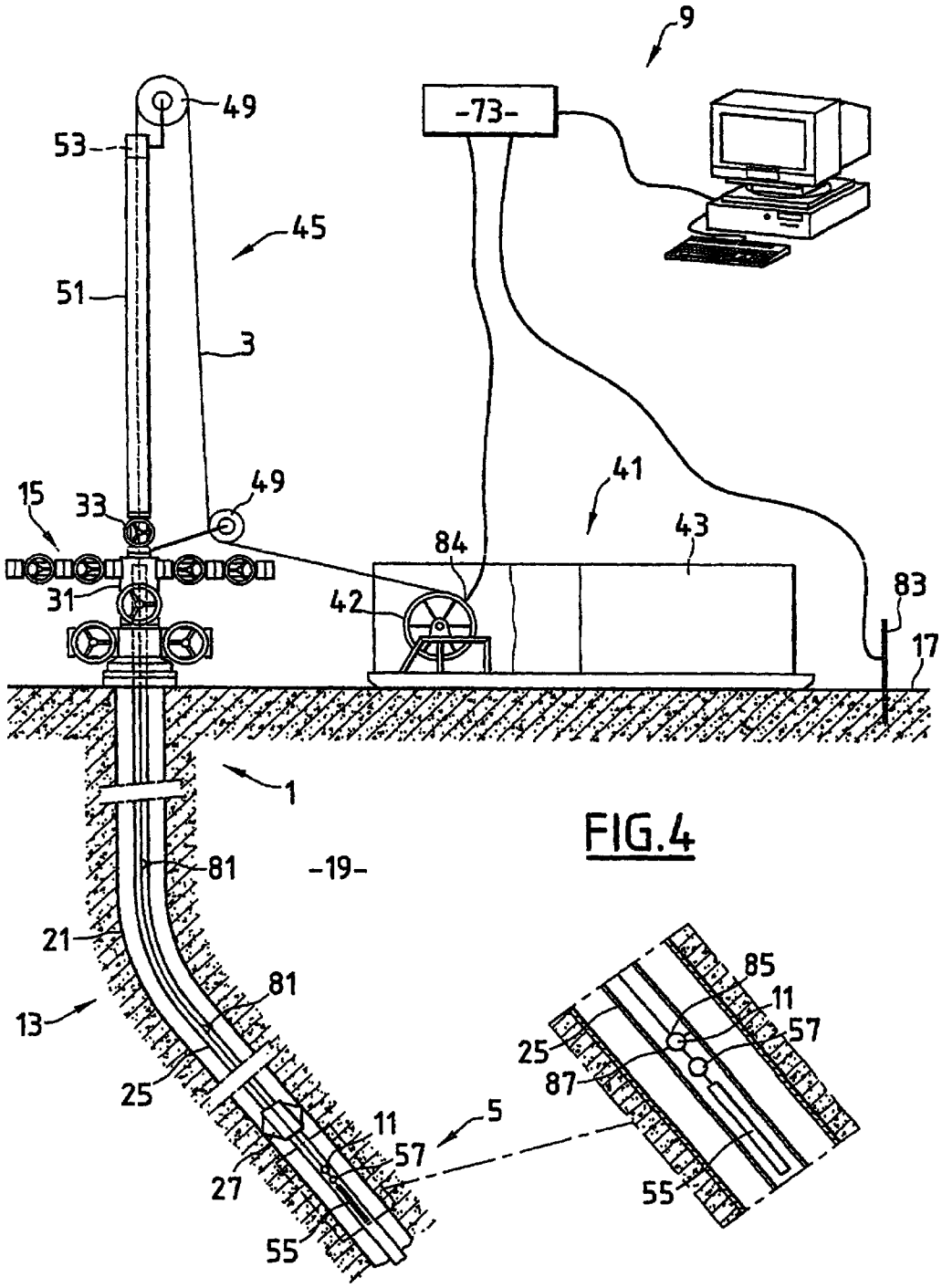
FIG. 4 is a diagram of a third configuration of a transmission device of the invention.

A third data transmission device of the invention is shown in FIG. 4.

Unlike the device shown in FIG. 1, the surface of the smooth cable 3 has at least one point 81 of electrical contact with the second duct 25.

Furthermore, the first transceiver means 9 are connected electrically firstly to the smooth cable 3 and secondly to the subsurface formation 19 via a stake 83 of electrically conductive material that is plunged into the formation 19 at the surface of the ground 17.

In a variant, the stake 83 may be plunged into a seabed, if the installation relates to an off-shore borehole.

The operation of the third device of the invention is analogous to that of the first device of the invention.

Once the action and/or measurement assembly 5 has been positioned at the desired depth, the first transceiver means 9 transmit an electrical control signal. This signal is identical to that generated in the first device of the invention. It may therefore be generated by means that are identical.

This signal is injected into a first dipole formed firstly by the contact point 84 between the cable 3 and the first transceiver means, and secondly the stake 83. The electrical signal injected into this first dipole causes an electromagnetic control signal to propagate through the surrounding terrain, specifically an electromagnetic wave which contains the information that is to be transmitted. This electromagnetic control signal then moves down towards the bottom of the well, being guided by the smooth cable 3 and/or the second duct 25. The electromagnetic control signal is picked up by a second dipole formed firstly by the electrical contact point 81 of the cable 3 with the second duct 25 that is closest to the action and/or measurement assembly 5, and secondly the electrical contact point 87 between the second transceiver means 9 and the second duct 25, the second duct being electrically connected to the formation 19 by the centralizers 27 and the first duct 21. The electromagnetic signal received by the second dipole generates an electrical signal which is received by the second transceiver means 11.

Similarly, the confirmation signal from the action and/or measurement assembly 5 is generated in the form of an electrical signal injected into a first dipole formed firstly by the electrical contact point 81 between the cable 3 and the second duct 25 that is closest to the action and/or measurement assembly 5, and secondly the electrical contact point 87 between the transmitter means 11 and the second duct 25. This contact point is electrically connected to the formation 19. The electrical signal injected into the first dipole causes an electromagnetic control signal to propagate through the terrain surrounding the well, specifically an electromagnetic wave which contains the information to be conveyed. This electromagnetic confirmation signal then rises to the surface, being guided by the smooth cable 3 and/or the second duct 25. The electromagnetic confirmation signal is picked up by a second dipole formed between firstly the electrical contact point 84 between the first transceiver means 9 and the cable 3, and secondly the electrical contact point between the first transceiver means 9 and the formation 19 via the stake 83. The electromagnetic signal received by the second dipole generates an electrical signal which is received by the first transceiver means 9.

By means of the invention as described above, a device is obtained for transmitting data in real time between a tool situated at the end of a single-strand smooth cable of the "piano wire" type that is located down an oil production well installation, and a control member on the surface.

It is thus possible to take advantage simultaneously firstly of the mechanical properties of smooth cables for performing "slickline" operations, namely ease of providing sealing at the wellhead and high mechanical strength compared with twisted electrical cables, and secondly of the possibility of transmitting information in real time between the surface and a point downhole. This result is obtained surprisingly, in spite of the poor electrical conductivity properties of the smooth cable.

Furthermore, the device can easily be adapted to an existing installation.

The invention claimed is:

1. A transmission device for transmitting data in an installation for working fluids contained underground, the installation comprising a cavity defined in an underground formation and extending to the surface of the ground, and at least one electrically conductive tubular element having a first point at the surface of the ground and a second point within the cavity, the transmission device comprising:

a single-strand smooth cable for supporting an action and/or measurement assembly, said cable having a breaking strength greater than 300 daN, being made of an electrically conductive material, and being disposed in the tubular element between the first point and the second point, wherein a surface of said cable is electrically insulated, at least in part, from the tubular element;

transmitter means for transmitting an electrical and/or electromagnetic signal, said transmitter means being situated in a vicinity of one or both of the first point and the second point, said transmitter means having:

a first electrical contact point with the tubular element; and a second electrical contact point with said cable, said second electrical contact point of said transmitter means being electrically separated from said first electrical contact point of said transmitter means such that said transmitter means can apply a voltage between said first electrical contact point of said transmitter means and said second electrical contact point of said transmitter means; and receiver means for receiving the electrical and/or electromagnetic signal, said receiver means being situated in a vicinity of the other one or both of the first point and the second point, said receiver means having:

a first electrical contact point with the tubular element; and a second electrical contact point with said cable, said second electrical contact point of said receiver means being electrically separated from said first electrical contact point of said receiver means such that said receiver means can detect a voltage between said first electrical contact point of said receiver means and said second electrical contact point of said receiver means, wherein said cable is a portion of a loop for conveying the electrical and/or electromagnetic signal between said transmitter means and said receiver means.

2. A transmission device according to claim 1, wherein said surface of said cable carries a continuous coating of insulating material and is electrically insulated from the tubular element.

3. A transmission device according to claim 2, wherein a thickness of said continuous coating of insulating material is equal to half the difference in diameter between two standard and non-coated cables.

4. A transmission device according to claim 1, wherein said surface of said cable is provided at regular intervals with centralizers of insulating material for electrically insulating said cable from the tubular element.

5. A transmission device according to claim 1, wherein said transmitter means and said receiver means are electrically connected to the at least one electrically conductive tubular element, wherein said surface of said cable carries a continuous coating of insulating material and is completely electrically insulated from the at least one electrically conductive tubular element, and wherein the electrical and/or electromagnetic signal transmitted by said transmitter means and received by said receiver means is an electrical signal.

6. A transmission device according to claim 1, wherein the at least one electrically conductive tubular element is at least a first tubular element and a second tubular element disposed inside said first tubular element, and wherein said cable is disposed in an annular space between said first tubular element and said second tubular element.

7. A transmission device according to claim 1, wherein the surface of the cable has at least one electrical contact point with the at least one electrically conductive tubular element, and wherein said transmitter means and/or said receiver means, and the at least one electrically conductive tubular element are electrically connected to the underground formation.

8. A transmission device according to claim 1, further comprising a conductor member anchored in the ground, wherein said conductor member electrically connects said transmitter means and/or said receiver means, in the vicinity of the first point, to the underground formation.

9. A transmission device according to claim 1, wherein said transmitter means and said receiver means are situated in the vicinity of the first point and the second point, respectively.

10. A transmission device according to claim 1, wherein said transmitter means is situated solely in a vicinity of one of the first point and the second point, and said receiver means is situated solely in a vicinity of the other one of the first point and the second point.

11. An installation for working fluids contained underground, the installation comprising:

a cavity defined in an underground formation extending to the surface of the ground and closed on the surface by a wellhead;

at least one electrically conductive tubular element provided in said cavity; and a transmission device according to claim 1.

12. An installation according to claim 11, further comprising an applicator device for applying an insulating coating on said cable.

13. An installation according to claim 12, wherein said applicator device is disposed inside an airlock preceding the wellhead, the airlock including a sealing device for said cable, said applicator device being located downstream from the sealing device.

14. An installation according to claim 12, further comprising:

deployment means for deploying said cable; and an alignment device for aligning said cable in the wellhead, said alignment device comprising at least one pulley, each pulley being electrically insulated from the wellhead and/or the underground formation, wherein said applicator device is disposed between said deployment means and said alignment device.

15. A transmission device according to claim 1, wherein said cable has a resistivity that is greater than 30 mΩ/m.

16. A transmission device according to claim 1, wherein said cable is a slickline cable or a "piano wire" cable.

17. A transmission device according to claim 1, wherein said second electrical contact point of at least one of said transmitter means and said receiver means is located outside of the cavity in the vicinity of the first point.

18. A transmission device according to claim 1, wherein each of at least one of said transmitter means and said receiver means in a vicinity of the first point are connected to said cable through a first electrical line and connected to the tubular element through a second electrical line different from the first electrical line.

19. A transmission device for transmitting data in an installation for working fluids contained underground, the installation comprising a cavity defined in an underground formation and extending to the surface of the ground, and at least one electrically conductive tubular element having a first point at the surface of the ground and a second point within the cavity, the transmission device comprising:

a single-strand smooth cable for supporting an action and/or measurement assembly, said cable having a breaking strength greater than 300 daN, being made of an electrically conductive material, and being disposed in the tubular element between the first point and the second point, wherein a surface of said cable is electrically insulated, at least in part, from the tubular element;

transmitter means for transmitting an electrical and/or electromagnetic signal, said transmitter means being electrically connected to said cable and to the tubular element and/or the underground formation, and being situated in a vicinity of the first point; and receiver means for receiving the electrical and/or electromagnetic signal, said receiver means being electrically connected to said cable and to the tubular element and/or the underground formation, and being situated in a vicinity of the second point, wherein said cable is a portion of a loop for conveying the electrical and/or electromagnetic signal between said transmitter means and said receiver means, wherein said surface of said cable has at least one electrical contact point with the at least one electrically conductive tubular element, wherein said transmitter means and/or said receiver means, and the at least one electrically conductive tubular element are electrically connected to the underground formation, wherein the electrical and/or electromagnetic signal transmitted by said transmitter means is injected to a first dipole comprising an electrical contact point between said cable and said transmitter means, and an electrical contact point between the underground formation and said transmitter means, wherein the first dipole generates an electromagnetic signal that is received by a second dipole comprising one of said electrical contact points between said cable and the at least one electrically conductive tubular element, and an electrical contact point between the at least one electrically conductive tubular element and said receiver means, and wherein the second dipole generates an electrical signal which is conveyed to said receiver means.

20. A transmission device for transmitting data in an installation for working fluids contained underground, the installation comprising a cavity defined in an underground formation and extending to the surface of the ground, and at least one electrically conductive tubular element having a first point at the surface of the ground and a second point within the cavity, the transmission device comprising:

a single-strand smooth cable for supporting an action and/or measurement assembly, said cable having a breaking strength greater than 300 daN, being made of an electrically conductive material, and being disposed in the tubular element between the first point and the second point, wherein a surface of said cable is electrically insulated, at least in part, from the tubular element;

transmitter means for transmitting an electrical and/or electromagnetic signal, said transmitter means being electrically connected to said cable and to the tubular element and/or the underground formation, and being situated in a vicinity of the second point; and receiver means for receiving the electrical and/or electromagnetic signal, said receiver means being electrically connected to said cable and to the tubular element and/or the underground formation, and being situated in a vicinity of the first point, wherein said cable is a portion of a loop for conveying the electrical and/or electromagnetic signal between said transmitter means and said receiver means, wherein said surface of said cable has at least one electrical contact point with the at least one electrically conductive tubular element, wherein said transmitter means and/or said receiver means, and the at least one electrically conductive tubular element are electrically connected to the underground formation, wherein the electrical and/or electromagnetic signal transmitted by said transmitter means is injected into a second dipole comprising one of said electrical contact points between said cable and the at least one electrically conductive tubular element, and an electrical contact point between the at least one electrically conductive tubular element and said transmitter means, wherein the second dipole generates an electromagnetic signal received by a first dipole comprising an electrical contact point between said cable and said receiver means and an electrical contact point between the underground formation and said receiver means, and wherein the first dipole generates an electrical signal that is conveyed to said receiver means.

* * * * *